United States Patent [19]

Goodman et al.

[11] Patent Number: 4,995,828

[45] Date of Patent: Feb. 26, 1991

[54] CONNECTOR FOR PAIRED WIRE CABLE

[75] Inventors: David S. Goodman, Sun City West, Ariz.; Edward Rudoy, Woodland Hills, Calif.

[73] Assignee: ITT Corporation, New York, N.Y.

[21] Appl. No.: 508,037

[22] Filed: Apr. 12, 1990

[51] Int. Cl.[5] ..... H01R 4/24

[52] U.S. Cl. ..... 439/405; 439/736; 439/497

[58] Field of Search ..... 439/492–499, 439/395–407, 638, 650–654, 736

[56] References Cited

U.S. PATENT DOCUMENTS

| | | | |
|---|---|---|---|
| 3,760,335 | 9/1973 | Roberts | 339/95 |
| 3,879,099 | 4/1975 | Shaffer | 439/397 |
| 4,083,615 | 4/1978 | Volinskie | 339/17 |
| 4,101,189 | 7/1978 | Moser et al. | 339/99 |
| 4,153,325 | 5/1979 | Asick | 339/99 |
| 4,209,219 | 6/1980 | Proietto | 339/99 |
| 4,252,397 | 2/1981 | Eigenbrode et al. | 339/99 |
| 4,258,975 | 3/1981 | Anderton | 339/97 |
| 4,262,984 | 4/1981 | Takahashi | 339/97 |
| 4,349,239 | 9/1982 | Roberts et al. | 339/97 |
| 4,351,582 | 9/1982 | Emerson et al. | 339/97 |
| 4,359,257 | 11/1982 | Lopinski et al. | 339/99 |
| 4,418,977 | 12/1983 | O'Shea, Jr. | 339/99 |
| 4,428,637 | 1/1984 | Worth | 339/99 |
| 4,431,248 | 2/1984 | Huntley et al. | 339/99 |
| 4,618,204 | 10/1986 | Saligny | 339/99 |
| 4,641,904 | 2/1987 | Kosugi et al. | 339/99 |
| 4,687,275 | 8/1987 | Ramisch et al. | 439/404 |
| 4,744,772 | 5/1988 | Reichardt et al. | 439/405 |
| 4,902,242 | 2/1990 | Davis et al. | 439/404 |
| 4,902,243 | 2/1990 | Davis | 439/405 |

*Primary Examiner*—David L. Pirlot

*Attorney, Agent, or Firm*—Peterson Thomas L.

[57] ABSTRACT

A connector is described which has contacts with wire termination ends (24) for connecting to two ribbon-like wire groups (16, 18) wherein the wires in each group alternate between grounded wires (26*c*) and signal-carrying wires (26*a*), and wherein the contacts have connector mating ends (22) arranged in two rows including one row (1) of signal contacts and another (2) of grounded contacts. The contacts are arranged in groups of four on an insulative body (40), with the termination ends (24*a*, 24*d*) of first and fourth contacts lying respectively on first and second sides (46, 48) of the body. The termination ends (24*b*, 24*c*) of second and third contacts are each bent to extend through a slot (66*b*, 66*c*) in the body so while the contact mating end (e.g. 22*b*) lies in a row (1) at one side of the body, its termination end (24*b*) lies in a row (6) at the other side of the body.

6 Claims, 3 Drawing Sheets

FIG. 2
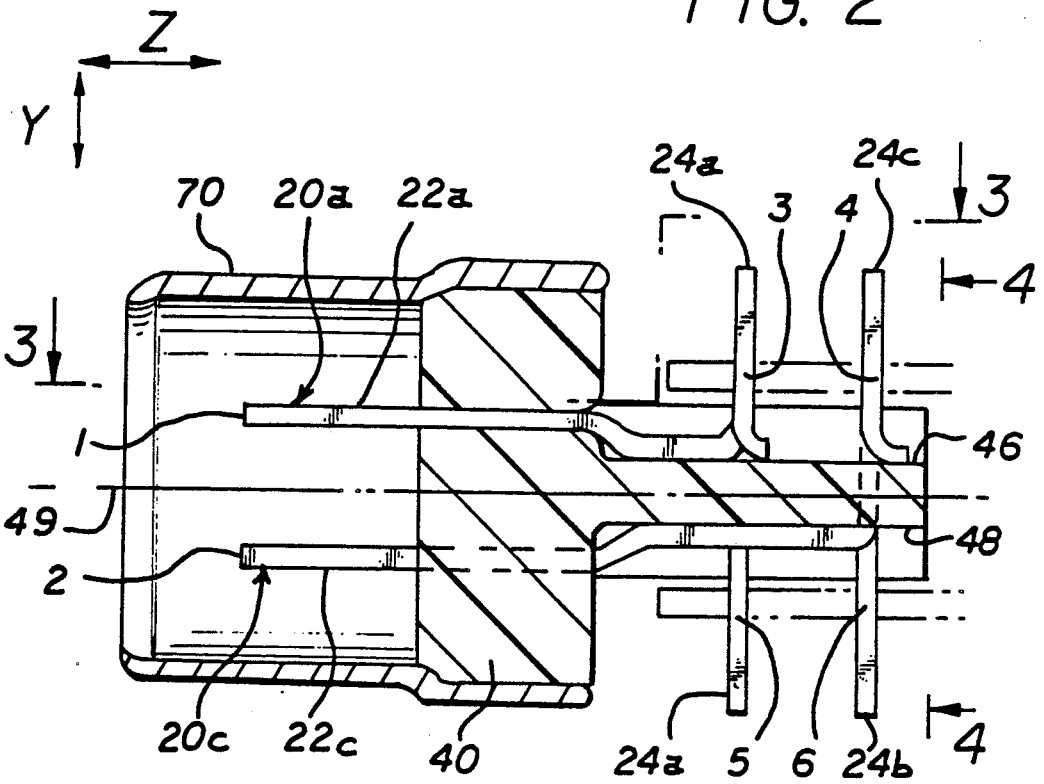
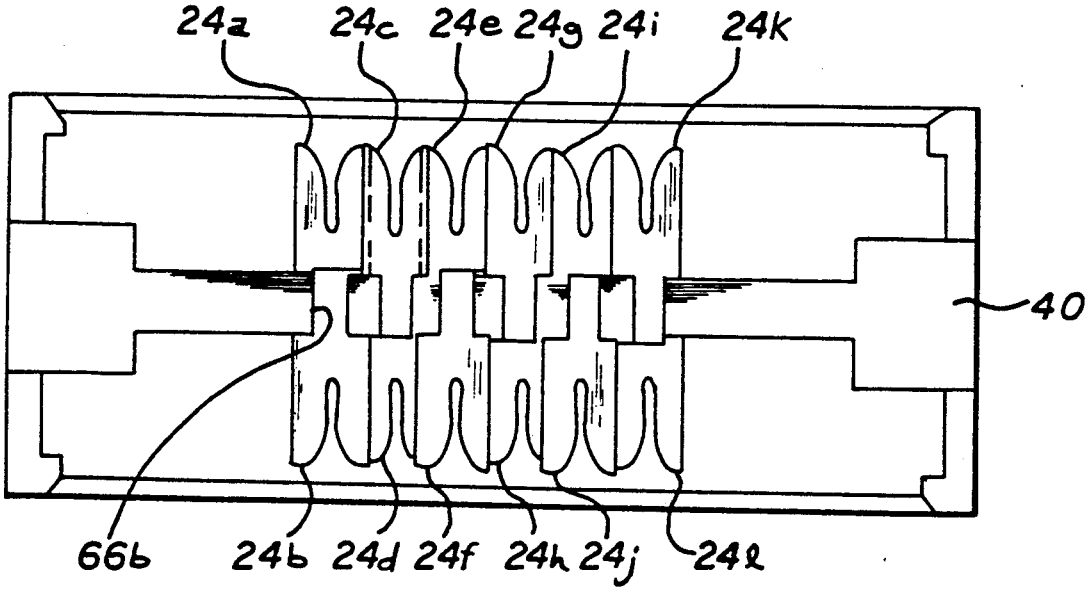
FIG. 4

CONNECTOR FOR PAIRED WIRE CABLE

BACKGROUND OF THE INVENTION

Crosstalk between many signal-carrying wires can be reduced by using twisted wire pairs, with one wire of the pair carrying a signal and the other being grounded. When a group of twisted wire pairs is to be connected to the contacts of a connector, it is often specified that the mating ends of the contacts be arranged in two rows, one row connected to the signal wires and the other row connected to the grounded wires. It is common to use contacts with insulation displacement wire termination ends to connect to the wires. A common arrangement is to use straight contacts with the mating ends and wire termination ends of a first group of contacts lying on a first side of an insulative body, and with the mating and termination ends of a second group of contacts lying on the second side of the body. In that case, the twisted wire pairs must be separated immediately before the connector, with the signal wires all routed to one side of the body and the grounded wires all routed to the other side of the body.

The need to route the two wires of each twisted pair to different sides of the body hampers the termination of the wires to the contacts. In many cases, a ribbon cable could be used with alternate wires of the ribbon cable being grounded, but the need to separate the wires of the ribbon cable and route them to opposite sides of the insulative body prevents simple mass termination of a ribbon cable to the wire termination ends of a group of contacts. A connector which enabled mass termination of the wires of a ribbon cable to the termination ends of a group of contacts, while assuring that the mating ends of the contacts were arranged in two rows with the signal-carrying contacts in one row and the grounded contacts in the other row, would be of considerable value.

SUMMARY OF THE INVENTION

In accordance with one embodiment of the present invention, a connector is provided which has contacts with mating ends arranged in two rows including a first row of signal contacts and a second row of grounded contacts, wherein the wire termination ends of the contacts can connect to a cable with alternating grounded and signal wires that all terminate at one side of an insulative body of the connector. The termination end portions of first contacts on one side of the insulative body, extend substantially straight so their termination and mating ends lie on the same side of a center plane of the body. Second contacts which alternate with the first ones, have their termination and mating ends on opposite sides of the body, with their termination end portions extending through a slot in the body.

The contacts can be arranged to connect to two groups of wires such as two ribbon cables lying at opposite sides of the insulative body. In that case, the contacts can be arranged in groups of four, with a first contact of the group having its mating and termination ends both on a first side of the center plane of the insulative body. A fourth contact of the group has its mating and termination ends both on the second side of the body. The second contact of the group has its termination end on the first side of the body and its mating end on the second side, while the third contact has its termination end on the second side of the body and its mating end on the first side.

The novel features of the invention are set forth with particularity in the appended claims. The invention will be best understood from the following description when read in conjunction with the accompanying drawings.

BRIEF DESCRIPTION OF THE DRAWINGS

FIG. 2 is a sectional view of the connector of FIG. 1, with the wire groups shown in phantom lines in terminated positions.

FIG. 4 is a view taken on the line 4—4 of FIG. 2.

DESCRIPTION OF THE PREFERRED EMBODIMENT

Figure 1:
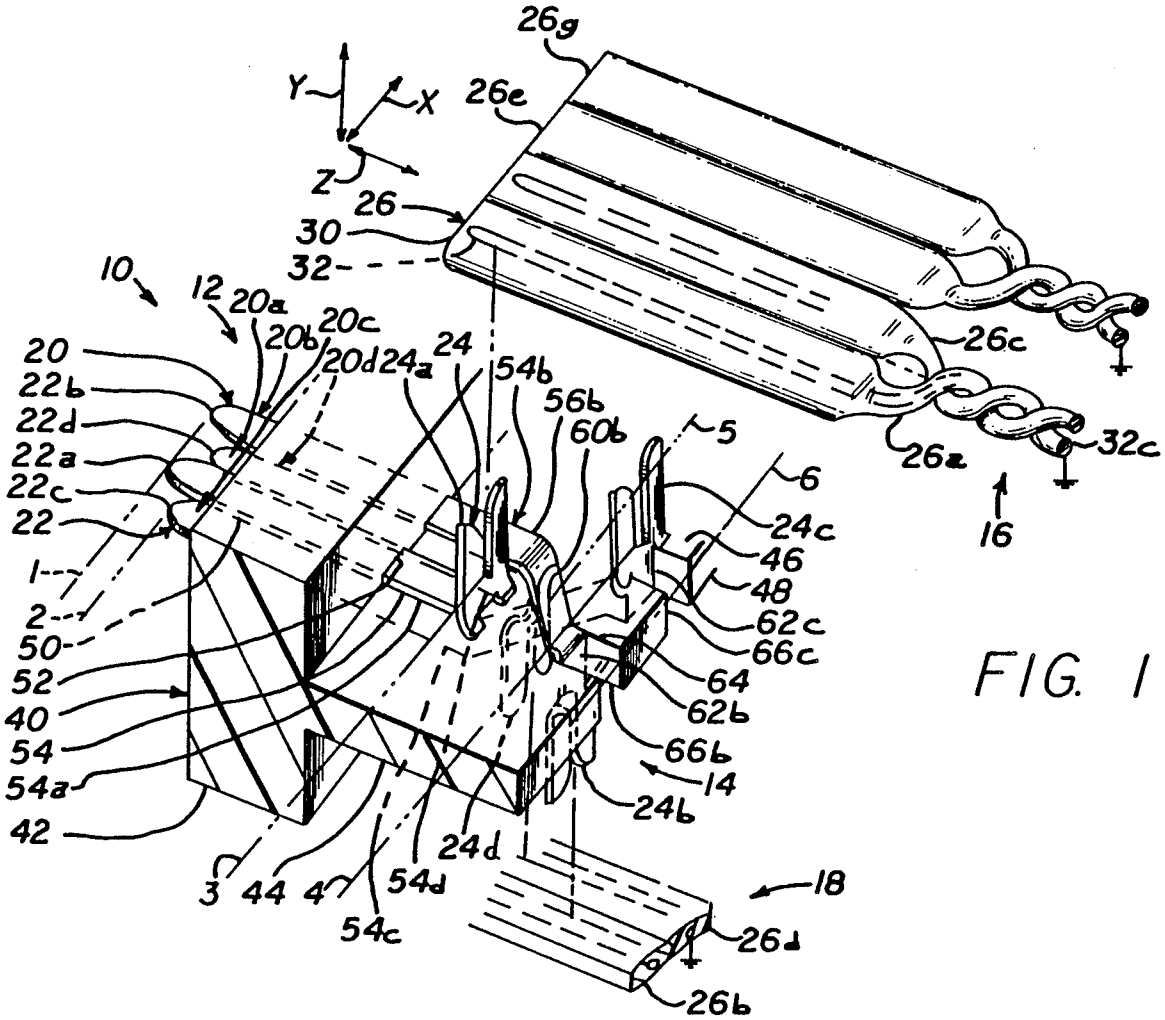
FIG. 1 is a partial perspective view of a connector constructed in accordance with the present invention, and showing two groups of twisted wire pairs positioned for connection to the connector.

FIG. 1 illustrates a connector 10 which has a mating end portion 12 for mating to another connector, and which has a wire termination end portion 14 for terminating to two groups of wires 16, 18. The connector includes contacts 20 that each has a mating end 22 in the form of a pin which can mate with a socket contact of another connector. Each contact also has a wire termination end 24 for terminating to one of the wires of the groups 16, 18. Each of the wires 26 of a group extends in a direction indicated by arrow Z. The wires of each group are spaced apart along a direction indicated by arrow X. The two groups of wires are spaced apart along a third direction Y. Each pair of directions such as X and Y are perpendicular, and the three directions X, Y, and Z are orthogonal.

The mating ends 22 of the contacts lie in two rows labelled 1 and 2 that each extend in the X direction, with the two rows spaced apart in the Y direction. The termination ends 24 of the contacts lie in four rows labelled 3, 4, 5, and 6. Each contact termination end is of an insulation displacement type, which penetrates the insulation of a wire and makes contact with the conductor of the wire. Each wire includes a wire insulation 30 and a central conductor 32. The wires are arranged in twisted wire pairs, with each pair of wires such as **26*a*, 26*c* having portions that lie adjacent and which may be twisted about one another. One of the wires 26*c* of the pair is a grounded wire, with its conductor 32*c* being electrically grounded. The other wire 26*a*** of the pair carries a signal, which is usually of high frequency (e.g. a high frequency digital signal). Providing a grounded wire between pairs of signal wires, especially with the grounded wire twisted about a corresponding signal wire, reduces crosstalk between signal wires. Although twisting greatly reduces crosstalk, crosstalk is reduced to a large extend by grounding alternate wires of a ribbon cable.

Users of the connectors often require that the mating ends 22 of the contacts lie in two rows, with one of them such as row 1 occupied only by the mating ends of signal-carrying contacts, and the other row 2 occupied only by grounded contacts. There can be some difficulty in routing the wires, so that the grounded wires of the two groups (e.g. **26*c*, 26*d*) connect to contacts with mating ends in the second row 2, while the signal carrying wires (e.g. 26*a*, 26*b*) connect to contacts with mating ends lying in a first row 1**. Previously, the wires of each twisted pair had to be separated and routed to opposite sides of the connector, which prevented low cost mass termination. The connector of the present invention is constructed to facilitate such routing and allow mass termination of the wires to the contacts.

The contacts 20 are arranged in groups of four, and are labelled 20*a*–20*d*. The contacts are mounted on an insulative body 40 which has connector and termination end portions 42, 44. The termination end portion has first and second opposite sides 46, 48. As shown in FIG. 2, the termination end 24*a*–24*d* of each contact lies on one or the other side 46, 48 of the body termination end portion, and of a centerplane 49 of the body. The mating end such as 22*a*, 22*c* of each contact also lies on one or the other side of the body (of its center plane 49).

Figure 3:
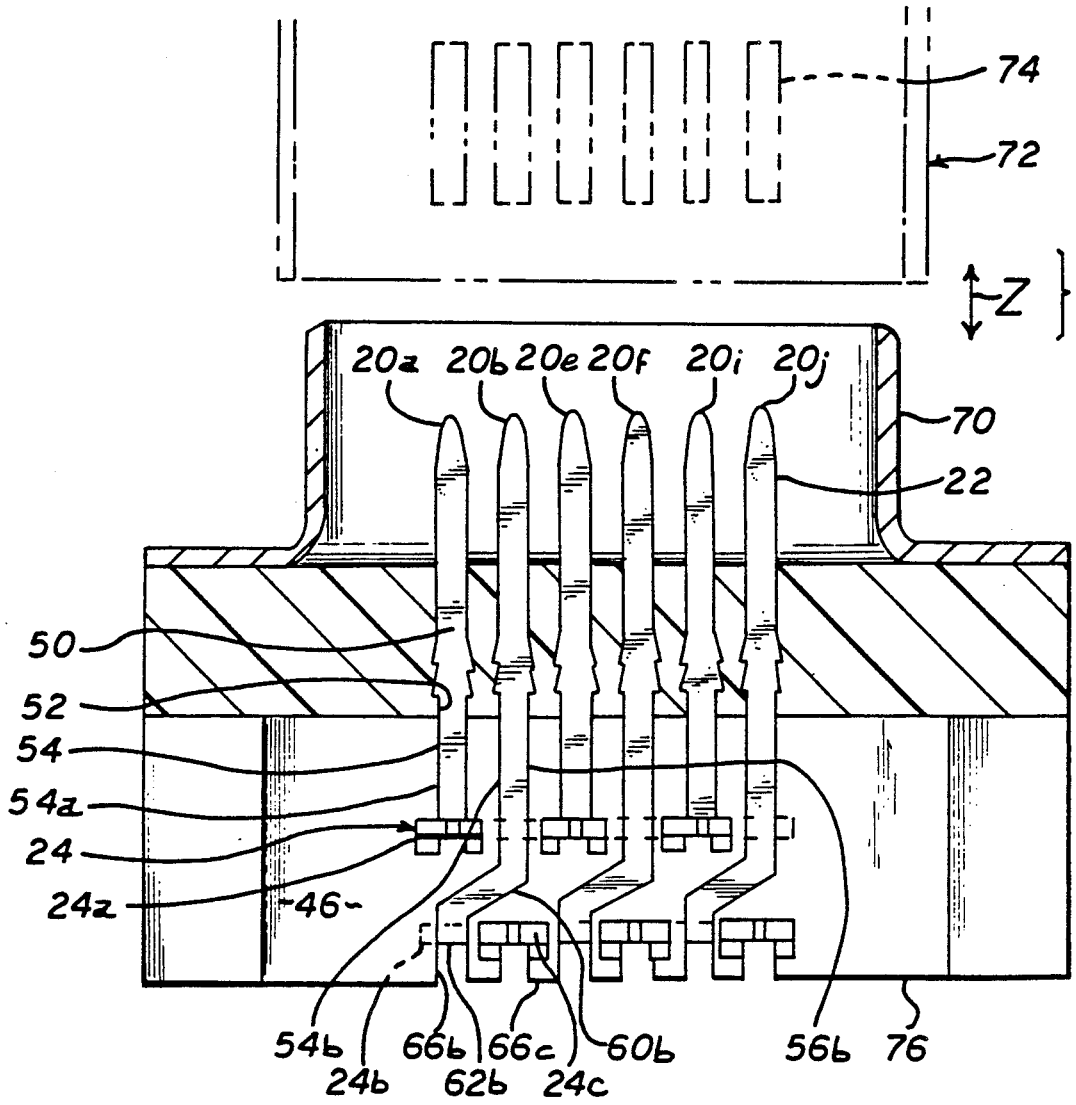
FIG. 3 is a view taken on the line 3—3 of FIG. 2, and also showing a second connector which is mateable to the connector of FIG. 2.

Referring to FIG. 3, it can be seen that each contact has a mating portion 50 that extends through a hole 52 in the body. Each contact also has a termination portion 54 that extends from the mating portion to the termination end 24. The termination portions 54 of some of the contacts are convoluted in order to route the connections.

The termination portion 54*a* of the first contact extends in substantially a straight line along the upper or first side 46 of the body. Similarly, the inner portion 54*d* (FIG. 1) of the fourth contact extends in substantially a straight line from its mating end 22*d* to its termination end 24*d*. The termination portion 54*b* (FIG. 3) of the second contact includes an inner part 56*b* that extends substantially straight along the Z direction on the upper side 46 of the body, and a middle part 60*b* that extends at an angle to the Z direction along the upper body side. The termination portion of the second contact also includes an outer part 62*b* that has a 90° bend at 64 (FIG. 1) about the X direction and which extends in the Y direction through a slot 66*b* in the body. The outer part 62*b* is offset from an extension of the inner part 56*b*, and the angled middle part (which can extend directly along the X direction or at an angle to it) connects those offset inner and outer parts. The bend 64 in the outer part allows the termination end 24*b* of the second contact to project from the second or lower side 48 of the body. The third contact 20*c* is of the same shape as the second contact, with its termination portion 54*c* having inner and middle parts extending along the lower side of the body and having an outer part 62*c* projecting through another slot 66*c* so that its termination end 24*c* can project from the first or upper side of the body. The other contacts in a connector with many additional contacts, can also be considered to be arranged in groups of four and have the same configurations as contacts 20*a*–20*d*.

The termination ends 24*a*, 24*b*, 24*c* and 24*d* (FIG. 2) lie in four rows respectively labelled 3, 4, 5, and 6. The two rows 3, 4 on the first or upper side of the body are spaced apart along the Z direction. As a result, the termination ends 24*a*, 24*c* which will contact adjacent wires 26*a*, 26*c* of the group of wires 16, do not have to be very narrow. Rows 3 and 5 are spaced apart largely in the Y direction, as are the other two rows 4 and 6.

Each group of wires such as 16 (FIG. 1) are arranged with alternate wires such as 26*a*, 26*e* carrying signals and the alternate wires therebetween 26*c*, 26*g* being grounded. The present arrangement of contacts assures that when the group of wires such as 16 is mass terminated to the wire displacement termination ends 24 of the contacts on one side of the connector, that all signal and grounded wires will be routed properly so their mating ends will lie in the proper rows 1 or 2. Where only moderate protection from crosstalk is required, it may be sufficient to use simple ribbon cables. Where greater protection from crosstalk is required, each group of wires can be constructed with pairs of wires such as 26*a*, 26*c* twisted about each other except for ribbon-like locations, each perhaps a couple of inches long and spaced a foot apart along the length of the cable. At the ribbon-like locations, the wires assume a ribbon cable construction where they can be mass terminated to the termination ends of the contacts of the connector.

FIGS. 2 and 3 show that the connector includes a metal shell 70 about the insulative body. The connector 10 is designed to mate with a second connector 72 with socket contacts 74 that receive the pin-like mating ends 22 of the contacts 20.

Each of the contacts is constructed of sheet metal, and is bent to its final form before installation on the insulative body 40. Each contact is installed by projecting its mating end 22 through a corresponding hole 52 in the insulative body. The body slots such as 66*b*, 66*c* extend to the extreme inner end 76 of the insulative body, to enable installation of the contacts 20*b*, 20*c* which have inner portions with middle parts that extend at an angle from the Z direction and with bent outer parts that extend in the Y direction to the wire termination ends.

Thus, the invention provides a connector with multiple contacts arranged with their wire termination ends positioned to engage alternate wires of a ribbon cable or similar group on one side of an insulative body of the connector, with the mating ends of the contact arranged in two separate rows, so contacts that terminate to alternate wires have their mating ends all lying in the same row. The contacts can be said to be arranged in groups of four, with two of the contacts (20*a*, 20*d* ) each extending substantially straight along a different side of the insulative body, and with two other contacts (20*b*, 20*c* ) having termination end portions that include inner parts extending in a Z direction on one side of the insulative body, a middle portion extending to at an angle to the Z direction but also on the first side of the body, and an outer portion with a 90° bend and extending in the Y direction to project from the opposite side of the body.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a connector which has a connector mating end portion for mating with another connector by movement along a predetermined mating direction Z, and a wire termination end portion for connecting to two ribbon-like wire groups that have wires extending along said Z direction, with the wires in each group spaced apart along a direction X that is perpendicular to said direction Z and wherein the wires in each group include alternate grounded and signal-carrying wires, and wherein the connector includes a plurality of contacts that each has a wire termination end and a mating end, with the mating ends arranged in first and second rows wherein the contacts whose mating ends lie in the first row carry signals and the contacts whose mating ends lie in the second row are grounded, and wherein said first and second rows are spaced apart largely along a direction Y which is orthogonal to said directions Z and X, the improvement wherein:

said contacts are arranged in groups of four that include first, second, third, and fourth contacts having wire termination ends lying respectively in third, sixth, fourth and fifth rows, and mating ends lying respectively in said first row, first row, second row and second row;

said connector defining an imaginary centerplane that is normal to said Y direction and that has opposite sides, said third and fourth rows lying on one of said sides of said centerplane and being spaced apart along said Z direction, said fifth and sixth rows lying on an opposite side of said centerplane and being spaced apart in said Z direction;

said third and fifth rows being spaced apart largely in said Y direction, and said fourth and sixth rows being spaced apart largely in said Y direction.

2. The improvement described in claim 1 wherein:

said connector includes a body of insulative material with a termination end portion that has first and second opposite sides spaced apart along said Y direction and lying on said opposite sides of said centerplane;

said first contact has a termination end portion lying on said first side of said body and merging with said first contact termination end;

said second contact has a termination end portion with an inner part lying on said first side of said body, and with an outer part extending through the thickness of said body to said second body side and merging with said second contact termination end;

said third contact has a termination end portion with an inner part lying on said second side of said body and an outer part extending through the thickness of said body to said first side and merging with said third contact termination end;

said fourth contact has a termination end portion lying on said second side of said body and merging with said fourth contact termination end.

3. The improvement described in claim 2 wherein:

said inner part of said second contact termination end portion extends along said Z direction, said outer part thereof is spaced in said X direction from an imaginary extension of said inner part thereof, and said second contact termination end portion also includes a middle part which extends at an angle to said Z direction and joins said inner and outer parts thereof;

said inner part of said third contact termination end portion extends along said Z direction, said outer part thereof is spaced in said X direction from an imaginary extension of said inner part thereof, and said third contact termination end portion also includes a middle part which extends at an angle to said Z direction and joins said inner and outer parts thereof.

4. A connector comprising:

an insulative body which extends along orthogonal X, Y and Z directions, said body having a centerplane that is normal to said Y direction;

a plurality of contacts mounted on said body, each contact having a mating end and an insulation displacement wire termination end, said mating ends arranged in first and second parallel rows extending along said X direction with said two rows spaced apart along said Y direction;

said contacts arranged in groups of four with different termination ends lying respectively in third, fourth, fifth, and sixth rows that each extends along X direction, with said third and fourth rows spaced apart along said Z direction and lying on a first side of said centerplane, and with said fifth and sixth rows spaced apart along said Z direction and lying on a second side of said centerplane;

a first contact in said group having a mating end lying in said first row and a termination end lying in said third row;

a second contact in said group having a mating end lying in said first row and a termination end lying in said sixth row;

a third contact in said group having a mating end lying in said second row and a termination end lying in said fourth row;

a fourth contact in said group having a mating end lying in said second row and a termination end lying in said fifth row.

5. The connector described in claim 4 wherein:

said body has a termination end portion with first and second opposite sides;

said contacts are formed of sheet metal, and said second contact is formed with a termination end portion having an inner part extending along said Z direction on said body first side, a middle part extending at an angle to said Z direction and lying on said body first side, and an outer part offset from an extension of said inner part and having a bend of about 90° about an axis extending in said X direction and extending through the thickness of said body termination end portion to said second side thereof and merging with said second contact outer end, with said second contact outer end extending along said Y direction away from said body portion second side;

said third contact is of substantially the same shape as said second contact but is positioned with an inner part lying on said body second side and an outer part extending to said body portion first side and said third contact outer end extends along said Y direction away from said body portion first side.

6. The connector described in claim 4 wherein:

said contacts are formed of sheet metal and each has a mating portion extending to a corresponding one of said mating ends, and said body has a thick mating end portion and a thinner termination end portion forming said first and second opposite sides;

said body mating end portion has a pair of rows of holes through which said contact mating portions extend, and said body termination end portion has a plurality of slots in its extreme termination end into which said outer parts of said second and third contacts can be installed.

* * * * *